US009924751B2

(12) United States Patent
King

(10) Patent No.: US 9,924,751 B2
(45) Date of Patent: Mar. 27, 2018

(54) PARACORD SURVIVALIST BELTS/BRACELETS AND MAGNETIC SAFETY RELEASE

(71) Applicant: Jarod Lee King, Ceres, CA (US)

(72) Inventor: Jarod Lee King, Ceres, CA (US)

( * ) Notice: Subject to any disclaimer, the term of this patent is extended or adjusted under 35 U.S.C. 154(b) by 136 days.

(21) Appl. No.: 15/207,532

(22) Filed: Jul. 12, 2016

(65) Prior Publication Data

US 2016/0316839 A1 Nov. 3, 2016

(51) Int. Cl.

| | |
|---|---|
| ***A41F 1/00*** | (2006.01) |
| ***A44C 5/20*** | (2006.01) |
| ***A41F 9/00*** | (2006.01) |
| ***A44C 5/00*** | (2006.01) |

(52) U.S. Cl.

CPC ..... *A41F 1/002* (2013.01); *A41F 9/002* (2013.01); *A44C 5/0053* (2013.01); *A44C 5/2071* (2013.01); *A44D 2203/00* (2013.01)

(58) Field of Classification Search

CPC ..... A41F 1/002; A41F 9/002; A44C 5/0053; A44C 5/2071; A44D 2203/00

USPC ..... 224/163

See application file for complete search history.

(56) References Cited

U.S. PATENT DOCUMENTS

| | | | | |
|---|---|---|---|---|
| 9,609,921 | B1 * | 4/2017 | Feinstein | A44C 5/2071 |
| 2015/0227245 | A1 * | 8/2015 | Inagaki | G06F 3/0412 345/173 |
| 2015/0378391 | A1 * | 12/2015 | Huitema | G06F 1/163 361/679.03 |
| 2016/0192743 | A1 * | 7/2016 | Sobbi | A45F 5/021 224/163 |
| 2016/0306393 | A1 * | 10/2016 | Huitema | G06F 3/0346 |
| 2016/0327987 | A1 * | 11/2016 | Huitema | G06F 1/1652 |
| 2017/0235341 | A1 * | 8/2017 | Huitema | G06F 1/1652 361/679.03 |

* cited by examiner

*Primary Examiner* — Peter Helvey

(74) *Attorney, Agent, or Firm* — Richard Brewster Main; Main Law Cafe

(57) ABSTRACT

Waistbands and wristbands include separable clasps suitable to join woven Paracord around a user's waist or wrist. Matching clasp pieces are attached to opposite ends of single lengths of woven Paracord and magnetically snap together and hold firm until twisted by the user or pulled apart by excess hauling force applied to the woven Paracord. Side slippage between matching magnetic plates of the clasps are textured with indentations and matching protrusions to control such slipping. In particular, such indentations and matching protrusions are concave and convex oval cones of matching height and base. These cones impart a ramping leverage effect that translates lateral movements into separating forces that both assist a user in dismounting the clasp by twisting and in the predicable and controllable release of the clasp subjected to longitudinal single-vector excess hauling force.

4 Claims, 3 Drawing Sheets

200

Figures 1A, 1B:
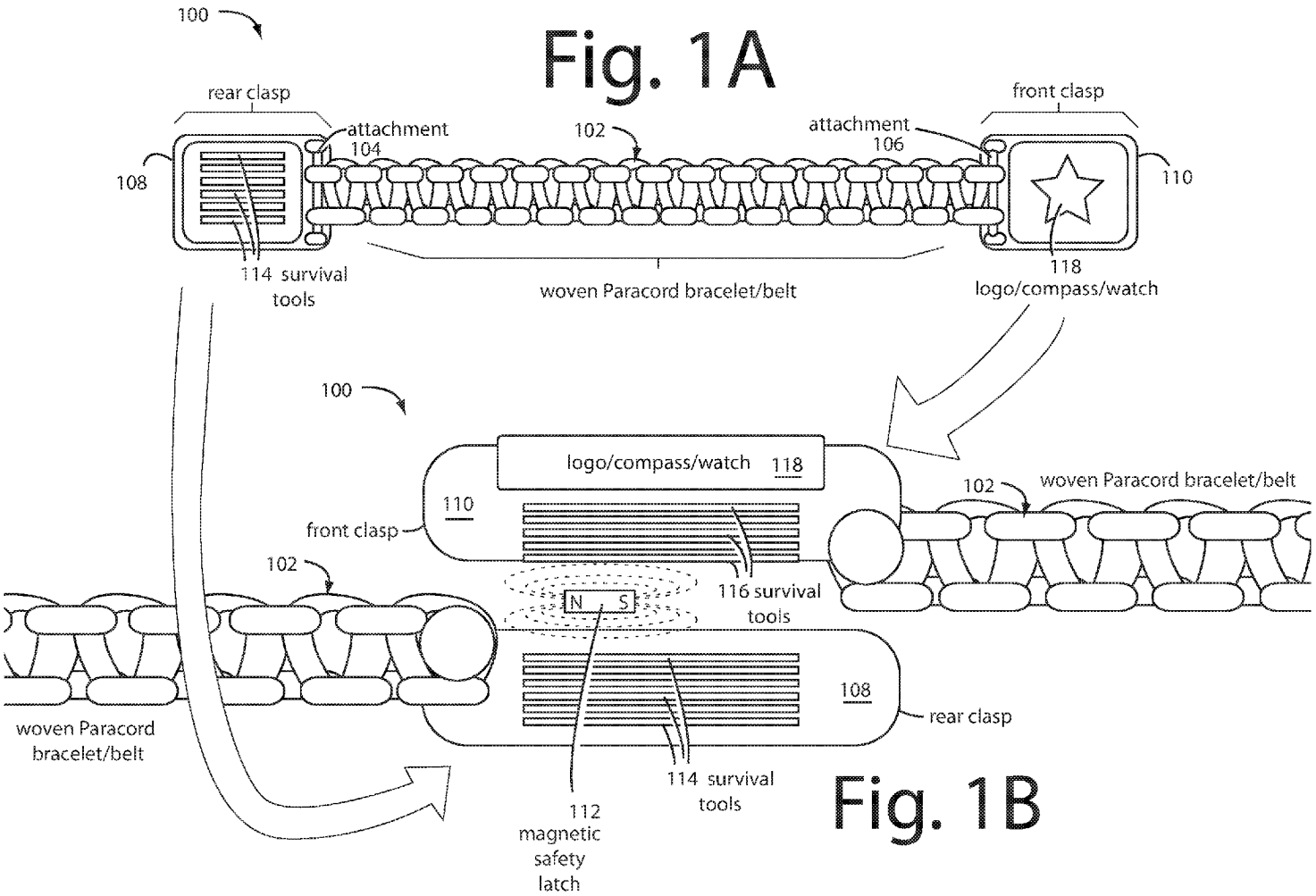

216
217
202
N
206
S
magnetic attracting force
high angle face
212
213
S
208
N
204
longitudinal
220
pulling apart force
200
low angle face 222
210
204
211
high angle face
magnet
208
lateral
narrow
212
wide
213
longitudinal
twisting apart force

PARACORD SURVIVALIST BELTS/BRACELETS AND MAGNETIC SAFETY RELEASE

FIELD OF THE INVENTION

The present invention relates to woven Paracord belts and bracelets with clasps, and more particularly to safety release mechanisms that will release the device from the user before a pulling force can injure the user should it become inadvertently snagged during use.

DESCRIPTION OF THE PRIOR ART

Paracord is a very strong and durable woven material that has many uses in survival emergencies. Survivalists are one group of modern users that have taken to Paracord in large numbers, and many try to keep Paracord close at hand for emergencies by wearing it woven into everyday clothing. Lately, several commercial retail sellers of Paracord products have begun offering Paracord woven into belts and bracelets that can be worn daily, or at least on field trips. Then, if an emergency arises, the Paracord in the belts and bracelets can be harvested and put to work in a number of improvised ways.

But the Paracord is so strong, and its strength multiplied when woven, that for all practical purposes it will not break. Not even under tons of force. This then becomes a problem when such woven Paracord is strapped around a user's waist in a belt or around a user's wrist in a bracelet. Should the belt or bracelet become un-expectantly snagged in machinery, tree branches, fencing, or other dangerous situations, these users can be injured because conventional Paracord devices do not automatically release.

What is needed is a releasing clasp that will not only secure the Paracord belts and bracelets, look attractive, function smartly, and not add significantly to the cost of mass producing consumer products, but one that will keep its users safe from harm.

SUMMARY OF THE INVENTION

Briefly, embodiments of the present invention comprise separable clasps suitable to join woven Paracord around a user's waist or wrist. Matching clasp pieces are attached to opposite ends of single lengths of woven Paracord and magnetically snap together and hold firm until twisted by the user or pulled apart by excess hauling force applied to the woven Paracord. Side slippage between matching magnetic plates of the clasps are textured with indentations and matching protrusions to control such slipping. In particular, such indentations and matching protrusions are concave and convex cones of equal height and base. These cones impart a ramping leverage effect that translates lateral movements into separating forces that both assist a user in dismounting the clasp by twisting and in the predicable and controllable release of the clasp subjected to longitudinal single-vector excess hauling force.

These and other objects and advantages of the present invention no doubt become obvious to those of ordinary skill in the art after having read the following detailed description of the preferred embodiments which are illustrated in the various drawing figures.

IN THE DRAWINGS

Figures 2A, 2B:
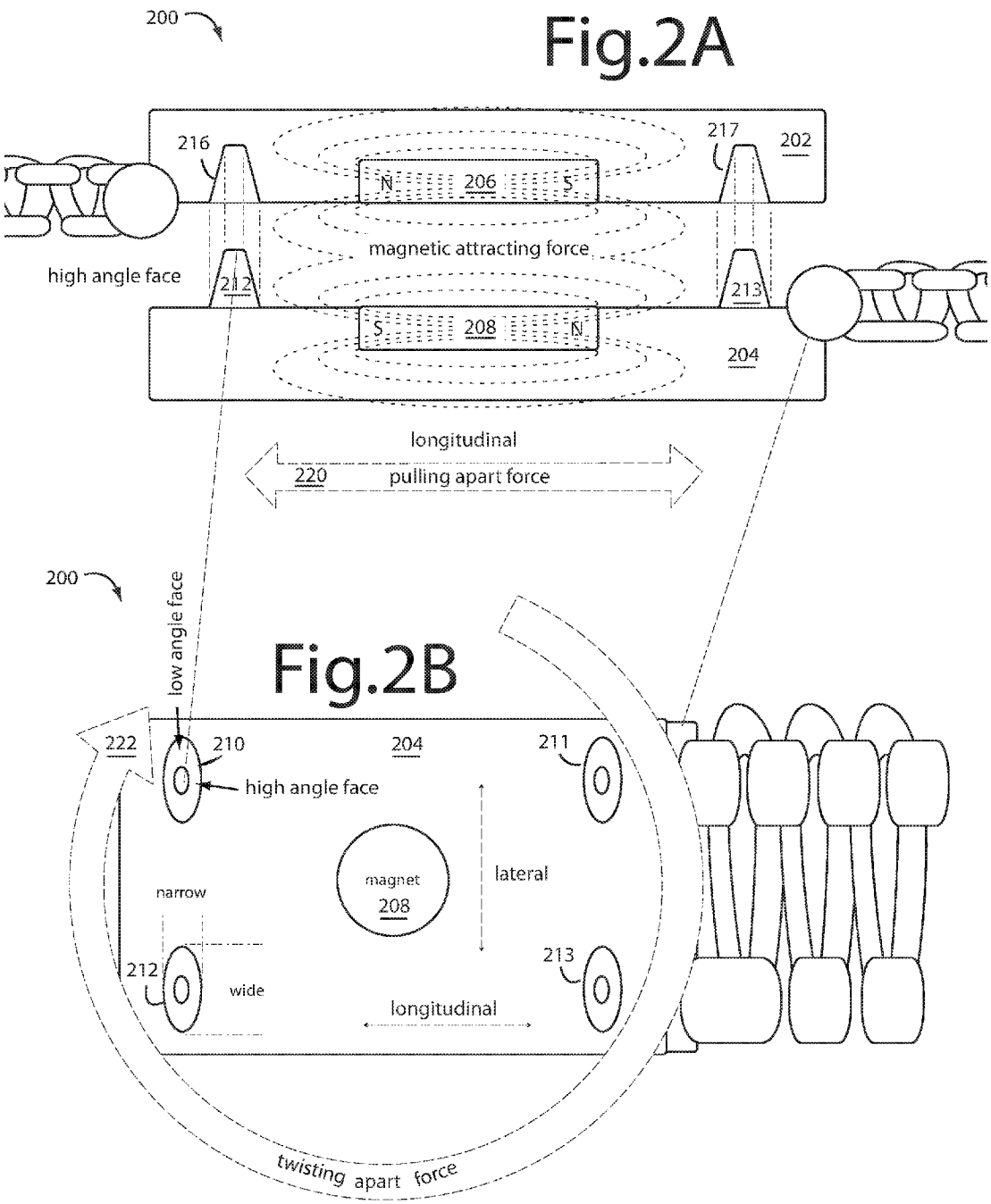
Figure 3:
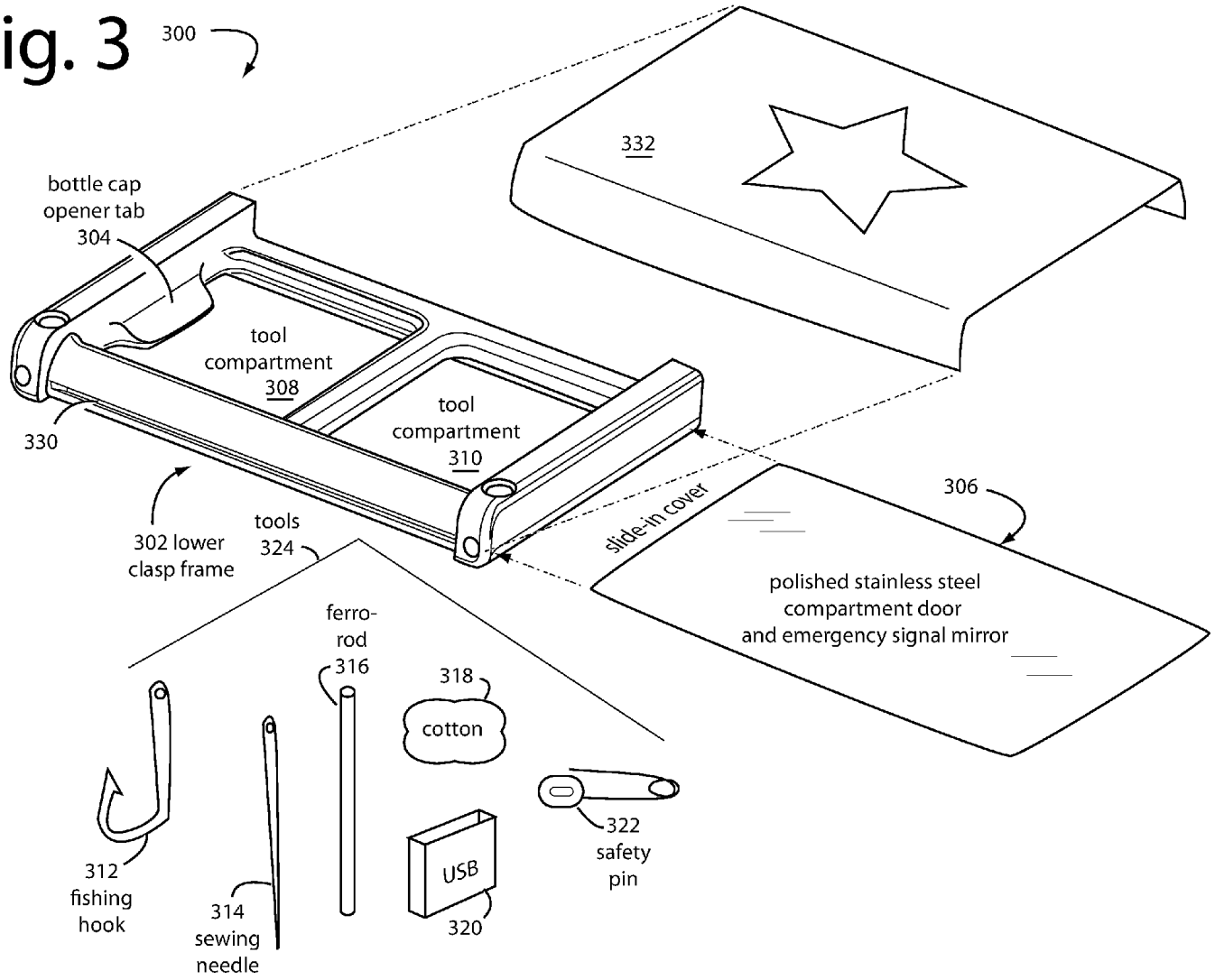

FIGS. 1A and 1B are top view and side view diagrams, respectively, of a waistband/wristband and safety clasp combination of the present invention;

FIGS. 2A and 2B are side view and inside view schematic diagrams of the relationships between the magnetic attracting force, the pulling apart force, and the twisting force as they all relate to the matching pairs of interlocking oval-base cones and dimples on the inside faces of the two-part clasp of FIGS. 1A and 1B; and FIG. 3 is an exploded assembly view of a clasp frame embodiment of the present invention as can be incorporated into the waistband/wristband and safety clasp combinations of FIGS. 1A, 1B, 2A, and 2B.

DETAILED DESCRIPTION OF THE PREFERRED EMBODIMENT

In general, Paracord Survival Clasp embodiments of the present invention include near identical top and bottom rectangular frame assemblies that are mutually attracted magnetically to the other and each attached to opposite ends of a woven Paracord belt or bracelet. The bare frames themselves are comprised of aluminum, stainless steel, titanium, or other non-corroding metals, and incorporate an array of magnets each arranged to clasp the two rectangular frame assemblies together.

Matching interlocks machined into each rectangular frame assembly resist a normal pulling apart force encountered in ordinary wear, and the interlocks are asymmetrically machined such that they will assist a user if the user applies a twisting action to open the clasp. If the pulling apart force exceeds a threshold safety magnitude, the clasp will separate automatically to protect the user from injury.

The rectangular frame assemblies further include a variety of survival tools. For example, a bottle opener, a polished stainless steel mirror, a ferrocerium fire starter, and standardized docking interface for mounting a watch, a compass, and other optional tools on a face top.

At a minimum, Paracord Survival Clasp embodiments of the present invention are a single piece with attachments on each side of the clasp for a Paracord band.

Referring now to FIGS. 1A and 1B, a woven Paracord belt/bracelet 100 includes a suitable length of woven Paracord 102 to fit a user's waist or wrist. Each end has an attachment 104 and 106 respectively to a rear clasp 108 and a front clasp 110. The two clasps hold themselves together during use with a magnetic safety latch 112. Cavities and compartments inside the rear clasp 108, and even the front clasp 110, incorporate a number of detachable survival tools 114 and 116. For example, fish hooks, threading needles, Ferrocerium rods, etc. The woven Paracord belt/bracelet 102 can be unwound and separated into fishing line and other useful filaments and cords. The front clasp 110 has a standardized docking interface to accept a variety of devices 118. For example, a logo badge, watch, compass, etc.

Ferrocerium is a man-made metal that is useful for the hot sparks it can produce when scraped against a rough surface such as ridged steel. Such pyrophoricity can generate temperatures of 3,000° C., or 5,430° F.). This property has been used in clockwork toys, strikers for gas welding and cutting torches, emergency survival kit flint-and-steel/flint spark lighter fire-starters, cigarette lighters, and an initial ignition source for many primary fuels. It is also commonly called ferro-rod, and is the common flint used in cigarette lighters. Ferrocerium-and-steels do function similarly to natural flint-and-steel in fire starting, but the ferrocerium shavings if removed quickly enough generate enough heat to ignite the shavings, converting the burning metal to its oxide. Its low ignition temperature is between 150° C. and 180° C. (302° F. and 356° F.)

FIGS. 2A and 2B illustrate how the clasps 108 and 110 can be constructed to require less force from the user to release them than is necessary for them to simply be pulled apart. A magnetic clasp 200 comprises top and bottom frames 202 and 204 made of titanium, stainless steel, aluminum, polycarbonate, or other very durable material that does not corrode or flex very much. In operation, top and bottom frames 202 and 204 are held together by matching rare earth magnets 206 and 208 embedded in the respective frames. Sideways slipping and thus separating of the top and bottom frames 202 and 204 is resisted by a number of oval cones 210-213 that raise from the top face of bottom frame 204 that respectively interlock with matching dimples 214-217 in the bottom face of top frame 202. We show four sets here, but any number of such pairs could be employed.

Magnets that are in contact with each other can be pulled straight apart or more easily twisted or slid apart. The interlocking function of oval cones 210-213 and matching dimples 214-217 (214-215 not shown) is such that the sliding apart option is directionally controlled. The oval cones 210-213 and matching dimples 214-217 are wider at their bases in their lateral direction and narrow in their longitudinal direction.

The effect of this is the oval cones 210-213 and matching dimples 214-217 present high angle faces in the longitudinal direction, the direction in which a pulling apart force 220 will be experienced. But a twisting force 222 will operate against a low angle face of the oval cones 210-213 and matching dimples 214-217. Such angled faces are in fact inclined ramps that impart different degrees of mechanical advantage.

The mechanical advantage of an inclined plane depends on its slope, its gradient or steepness. The smaller the slope, the larger the mechanical advantage, and the smaller the force needed to raise a given weight. A plane's slope s is equal to the difference in height between its two ends, or rise, divided by its horizontal length, or run. It can also be expressed by the angle the plane makes with the horizontal, θ.

$$\theta = \tan^{-1}\left(\frac{\text{rise}}{\text{run}}\right)$$

In our application, the rise is constant, but the run increases for the lateral direction over the longitudinal direction. The mechanical advantage MA of a simple machine is defined as the ratio of the output force exerted on the load to the input force applied. For our inclined plane, the output load force is the magnetic force on the plane, $F_m$. The input force is the force $F_i$ exerted between the frame pair, parallel to the plane, to move it up the cones inside the dimples. The mechanical advantage is, $$MA = \frac{F_m}{F_i}.$$

Referring now to FIG. 3, a clasp piece 300 includes a clasp frame 302 that rests against a user's body during use. A tab 304 has uses as a bottle cap opener, and is formed by machining or casting into clasp frame 302. It is accessible for use underneath. This arrangement allows the bottle cap opener tab 304 to be hidden when not needed, but it can be quickly deployed by unclasping the waistband/wristband, and then using the bottom side of clasp frame 302 as a fulcrum to pry a bottle cap off.

A lower-compartment sliding-door 306 seals off two tool compartments 308 and 310 in clasp frame 302. The lower-compartment sliding-door 306 is made of stainless steel, and is given a mirror polish. Such allows the sliding-door 306 to serve double-duty as an Emergency Signal Mirror. It further provides a good surface on which to strike a Ferrocerium rod.

Tool compartments 308 and 310 are typically equipped with a fishing hook 312, a sewing needle 314, a "Ferro-rod" 316, a cotton ball 318, a USB flash drive 320, a safety pin 322, and other survival tools. Such an assortment of tools is labeled by reference numeral 324 in FIG. 3

If necessary during a survival emergency, the figure-8 construction of the lower clasp frame 302 can be used to advantage as an miniature "super-8 belay" device once all the tools 324 are removed. To the maximum extent possible, every elemental piece of the woven Paracord belt/bracelet 100 has a secondary survivalist use.

A magnetic attachment docking interface 330 provides a standardized fit for mounting a device 332, e.g., a watch, compass, or default TITAN Star Ferrocerium striker. Any of a number of badges and emblems can also be magnetically attached with device 332, including personal vanity covers such as fan emblems for sports teams like the San Francisco 49ers, Oakland Raiders, or military service emblems such as US Army, Navy, Air Force, Marines, and Coast Guard.

Each end of the single-length of Paracord 102 is looped or attached to its respective side of the clasp 108, 110, 200, 300 with a connector-like attachment 104, 106. Such connectors may also advantageously incorporate Ferrocerium into the Paracord bracelet attachment ends. Each connector can have any of a number of conventional adjustment mechanisms that allow a fit to a range of wrist sizes in a single version.

In general, embodiments of the present invention comprise separable clasps suitable to join woven Paracord around a user's waist or wrist. Matching clasp pieces are attached to opposite ends of single lengths of woven Paracord and magnetically snap together and hold firm until twisted by the user or pulled apart by excess hauling force applied to the woven Paracord. Side slippage between matching magnetic plates of the clasps are textured with indentations and matching protrusions to control such slipping. In particular, such indentations and matching protrusions are concave and convex cones of equal height and base. These cones impart a ramping leverage effect that translates lateral movements into separating forces that both assist a user in dismounting the clasp by twisting and in the predicable and controllable release of the clasp subjected to longitudinal single-vector excess hauling force.

Since the longitudinal single-vector excess hauling force will apply itself in a direction orthogonal to a twisting-to-release action the user will apply, the two types of release can be engineered to have different efforts. For example, the bases of the concave indentations and matching convex protrusions are fabricated as ovals with the shorter dimension parallel to the longitudinal single-vector excess hauling force direction. Such makes for a steeper ramp that resists z-vector separation.

Although the present invention has been described in terms of the presently preferred embodiments, it is to be understood that the disclosure is not to be interpreted as limiting. Various alterations and modifications no doubt become apparent to those skilled in the art after having read the above disclosure. Accordingly, it is intended that the appended claims be interpreted as covering all alterations and modifications as fall within the true spirit and scope of the invention.

What is claimed is:

1. A waistband/wristband and safety clasp combination comprising:

a single length of Paracord woven into the form of a waistband or wristband and having clasp attachments at each of two ends;

a two-part clasp with each part separately joined to a respective clasp attachment;

a magnet assembly disposed in the two-part clasp that acts to keep each part of the two-part clasp latched together;

a number of interlocking oval-base cones and matching dimples disposed on adjoining inside faces of each part of the two-part clasp;

wherein the elements recited above are arranged and proportioned such that a separating, pulling-apart force necessary to be applied to mandate a release of the two-part clasp significantly exceeds a twisting force a user must apply to gain a release of the two-part clasp.

2. The waistband/wristband and safety clasp combination of claim 1, further comprising:

a number of removable survivalist tools pocketed into either or both of the parts of the two-part clasp.

3. The waistband/wristband and safety clasp combination of claim 2, wherein the number of removable survivalist tools pocketed into either or both of the parts of the two-part clasp includes a minimum of a fishing hook, a thread needle, and a Ferrocerium fire starter rod.

4. The waistband/wristband and safety clasp combination of claim 1, further comprising:

a standardized dock on an outward front facing side of one of the parts of the two-part clasp and that provides an attachment interlock for at least one of a watch, a compass, and a logo badge.

* * * * *